United States Patent [19]

Deschesnes

[11] 3,955,815

[45] May 11, 1976

[54] HOCKEY TRAINING DEVICE

[76] Inventor: Gilles Deschesnes, 3243 6e rue Chomedy, Laval, Quebec, Canada

[22] Filed: Feb. 27, 1975

[21] Appl. No.: 553,842

[30] Foreign Application Priority Data

June 4, 1974 Canada ..... 201623

[52] U.S. Cl. ..... 273/1 B; 273/200 A; 273/200 B; 273/184 B

[51] Int. Cl.² ..... A63B 69/00

[58] Field of Search ..... 273/1 B, 98, 122 R, 273/126 R, 200 R, 200 A, 200 B, 185 C, 185 D, 58 C, 182 R, 184 B, 187 R; 272/83 A

[56] References Cited

UNITED STATES PATENTS

| | | | |
|---|---|---|---|
| 2,253,063 | 8/1941 | Deibel | 273/185 C |
| 2,941,808 | 6/1960 | Smith et al. | 273/187 R |
| 2,959,414 | 11/1960 | Saltz | 272/83 A |
| 3,677,552 | 7/1972 | Werft | 273/184 B |

FOREIGN PATENTS OR APPLICATIONS

| | | | |
|---|---|---|---|
| 436/31 | 1/1931 | Australia | 273/184 B |

*Primary Examiner*—Richard C. Pinkham
*Assistant Examiner*—William R. Browne

[57] ABSTRACT

A hockey training device having a simulated puck, adapted to be propelled by a hockey stick over a playing surface. The puck is connected to to a resilient member which restrain the latter's motion over the playing surface. The puck is connected, through a slot, to a movable carriage beneath the playing surface. The carriage is connected to the resilient member the force of which can be adjusted. The force of the resilient member must be overcome in propelling the puck thus strengthening the player's shot. The resilient member return the puck to a start position after each practice shot.

6 Claims, 9 Drawing Figures

HOCKEY TRAINING DEVICE

This invention is directed toward a hockey training device.

The invention is more particularly directed toward a hockey training device for use in strengthening a hockey player's shot.

The invention relates to a simple, compact device which can be used by a hockey player to develop the strength of his various shots, such as his wrist shot, his slap shot, or his backhand. The player can practise his shots at home without having to go to a rink, or without having to put on skates. Also, the player can practise without having to retrieve his shots. The device employs a practice object which automatically returns to a start position after each practice shot. The practice device can be adjusted to make it progressively harder to shoot the practice object, thus gradually building up the shooting muscles of the player so that he develops a harder shot.

The invention is more specifically directed to a hockey training device which comprises an elongated platform having an elevated top practicing wall formed with a through slot that extends longitudinally over its major portion. A pair of guide members are provided each on one side of the slot, parallel to it and parallel to the practicing wall; the guide members being mounted beneath the practicing wall. A carriage is mounted beneath the practicing wall and has freely spinning wheels laterally mounted to ride on the guiding members. A vertical post projects from the carriage through the slot and above the practicing wall, a hockey puck being secured at the top of the post so as to be hit by a player whereby the puck and the carriage may be displaced from one end of the slot to the other when so hit.

Resilient return means including a spring loaded spool are provided beneath the practicing wall behind the end of the slot with respect to the other end of the slot. A cord is fixed at one end to the carrier and winds on the spool at the other end where the carrier is at the said one end of the slot whereby when the puck is hit by a player, it is propelled with the carriage toward the other end of the slot until its momentum is lost at which time the puck and the carriage return to the said one end under the action of the spring loaded spool.

Embodiments of the invention will now be described in detail having reference to the accompanying drawings in which.

Figure 1:
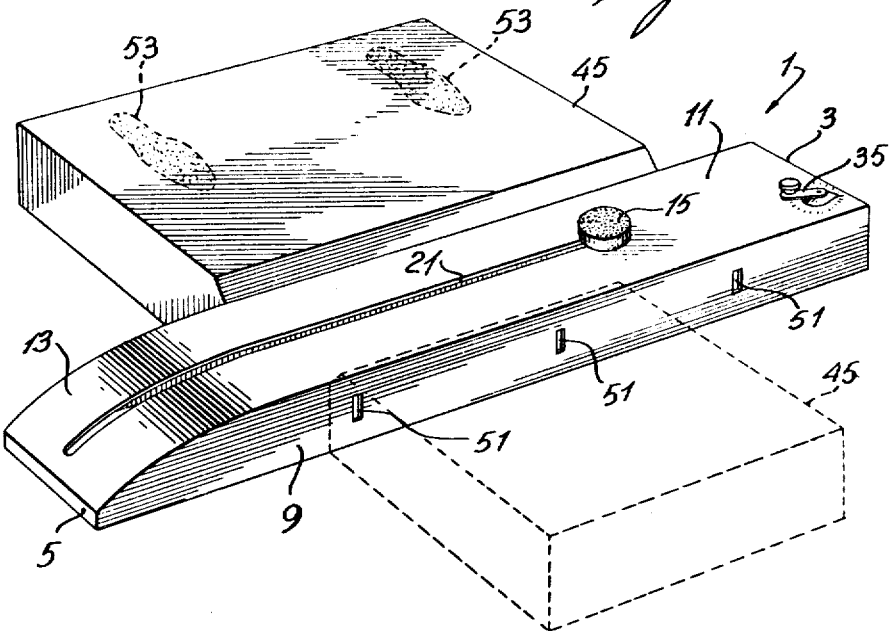
FIG. 1 is a perspective view of the training device.

As shown in FIG. 1, the hockey training device 1 has an elongated platform 3 with a front wall 5, back wall 7, side walls 9 a bottom wall 10, and a top wall forming a playing surface 11. The front end 13 of the playing surface 11 curves gently downwardly toward front wall 5.

An object such as a hockey puck 15, or facsimile thereof, adapted to be propelled by a hockey stick 16, is provided on the playing surface 11. Means are connected to the puck 15 for restraining its motion along the playing surface when propelled by the hockey stick. The puck 15 is connected to a wheeled carriage 17, beneath playing surface 11, by a vertical post 19 passing through a longitudinal slot 21 centrally located in the playing surface. The carriage 17 is H-shaped and is mounted on wheels 18 for linear movement on a pair of tracks 22 running parallel to slot 21. The slot 21 and tracks 22 extend from a point near the back wall 7 of platform 3 to the front wall 5 of the platform following the curved front end 13. The tracks 22 restrain the puck 15 to move in a linear direction along surface 11 when propelled forwardly by hockey stick 16. The ends 23, 24 of the tracks 22 are closed to retain the carriage 17 on the track 22.

The carriage 17 is connected to suitable resilient means against the bias of which the carriage must work when the puck, connected to the carriage, is propelled by a hockey stick. These resilient means form part of the restraining means and aid in developing strength by making it harder to propel the puck. The resilient means also return the puck to a start position after each practice shot. The resilient means comprise a cord 25 one end of which is attached to the rear end of carriage 17. The other end of the cord 25 is wound about a rotatable, spring-loaded spool 27 mounted adjacent back wall 7 of the platform. The cord 25 is threaded about a pair of spaced apart pulleys 29, 31 with one pulley 29 adjacent spool 27 and the other pulley adjacent the rear end 23 of tracks 22. Spool 27 has suitable adjustable spring tensioning means 33 connected to it and also part of the restraining means for the puck. These tensioning means 33 control the degree of freedom with which spool 27 rotates. The tighter the tensioning means are made, by way of a handle 35 projecting through playing surface 11, the harder it is to rotate spring-loaded spool 27 when unwinding the cord 25 off it, and thus the more force it takes to propel puck 15 toward the front end 13 of the playing surface 11.

In one embodiment the cord 25 may be inextensible while, in another, it may be elastic.

After the puck, and the carriage, has been propelled forwardly against the restraining force exerted by cord 25 via the return spring means (not shown) in spool 27, said spring means in spool 27 causes carriage 17 to return to the rear end 23 of tracks 22, thus returning the puck to a start position ready for another practice shot. Means are provided for cushioning the carriage 17 as it returns. These cushioning means comprise a pair of vertical elastic bands 39, each attached at its ends to the top wall 11 and bottom wall 10 of platform 3 and positioned in the path of carriage 17, just a bit in front of end 23 of tracks 22.

Figure 2:
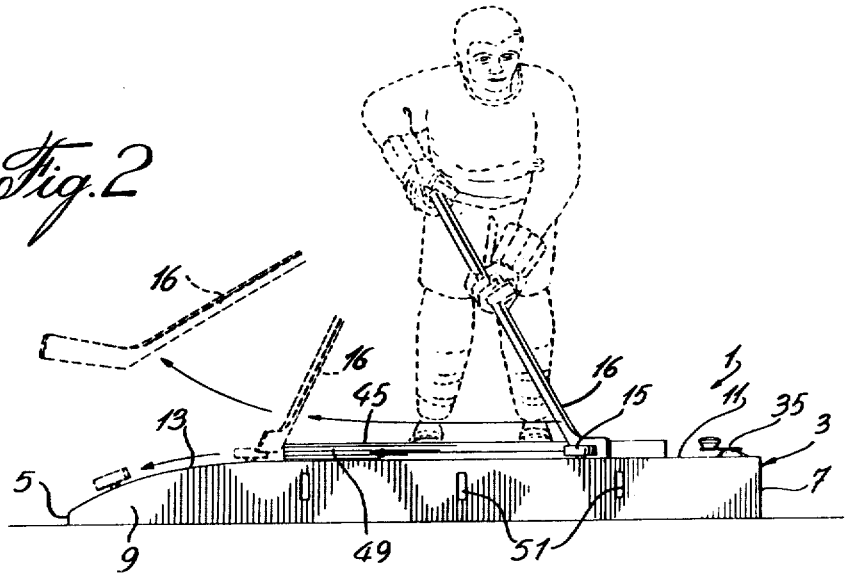
FIG. 2 is a front view of the training device showing how it is used.
Figure 7:
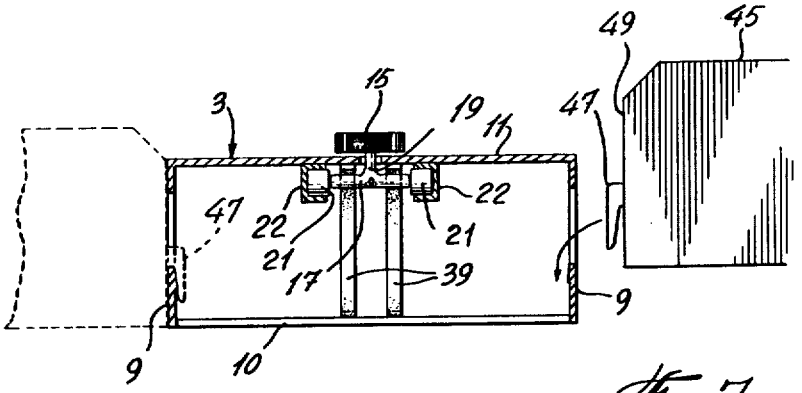
FIG. 7 is a transverse cross-sectional view of the device.
Figure 8:
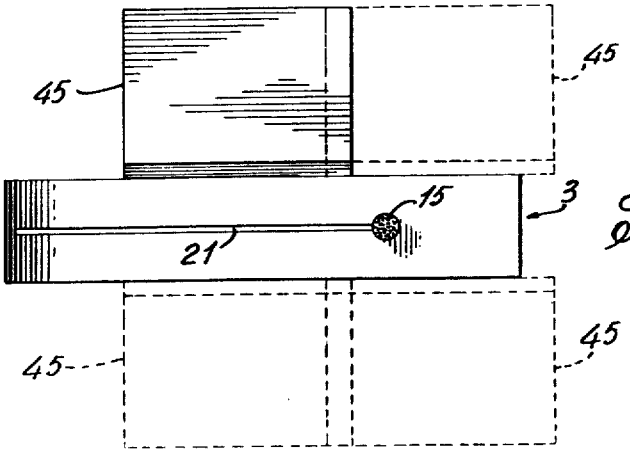
FIG. 8 is a plan view of the device.

The platform 3 can be made large enough for a player to stand on it on either side of slot 21. This however makes for a large platform which is expensive. As an alternative, a separate stand 45 may be provided. The stand 45 need only be large enough for a player to stand on it and is positioned alongside platform 3, the player standing on it while propelling the puck with a hockey stick, as shown in FIG. 2. In this embodiment the stand 45 is slightly higher than platform 3, as shown in FIG. 2 so as to place the player in a position relative to playing surface 11 as if the player were wearing skates. The stand 45 can be provided with projecting hooks 47 on one side wall 49, as shown in FIG. 7, which hook into slots 51 provided in both side walls 9 of the platform 3 so as to connect stand 45 to the platform. The stand 45 can be connected to platform 3 on either side of the platform, and in different positions along each side as shown in FIG. 8. The top of stand 45 is provided with non-slip surface areas 53, as shown in FIG. 1, on which the player stands when using the device.

Figure 3:
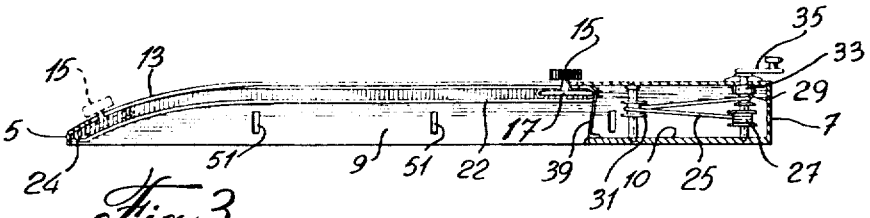
FIG. 3 is a longitudinal cross-sectional view of the device ready for use.
Figure 5:
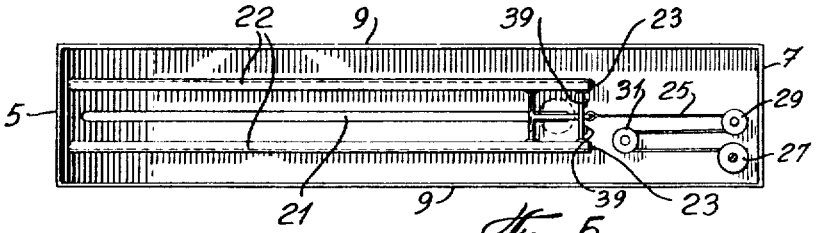
FIG. 5 is a bottom plan view of the device with the bottom removed.
Figure 4:
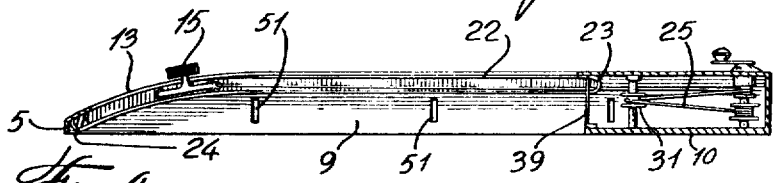
FIG. 4 is a longitudinal cross-sectional view of the device during use.
Figure 6:
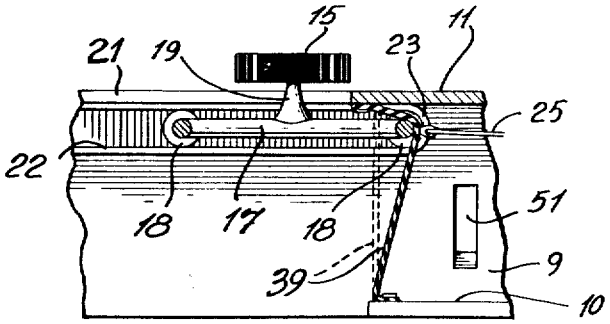
FIG. 6 is a detail view of the object on the device propelled by the hockey stick.

To use the device, the player positions stand 45 on one side or the other of platform 3, depending on whether he shoots a puck left-handed or right-handed and/or whether he wants to practise forehand or backhand shots. The stand 45 is attached to platform 3 by placing hooks 47 in slots 51 on the appropriate side 9 of the platform. The player then stands on non-slip areas 53 and propels the puck 15, along slot 21 from the start position shown in FIG. 3, forwardly toward the front end 5 of playing surface 11. The puck 15 follows the downward curve of the front end 5 of the playing surface, as shown in FIGS. 2 and 4, allowing the hockey stick to follow through on the practice shot unhindered. The puck 15 is propelled against the resilient force exerted by the spring-loaded spool 27 and the tensioning device 33. The tighter the tensioning device 33 is set, the harder it is to propel puck 15. The spring in the spool 27 serves to return the carriage and thus the puck to the start position after each practice shot. The return movement of the carriage to the start position is cushioned by the elastic bands 39, as aforesaid.

Figure 9:
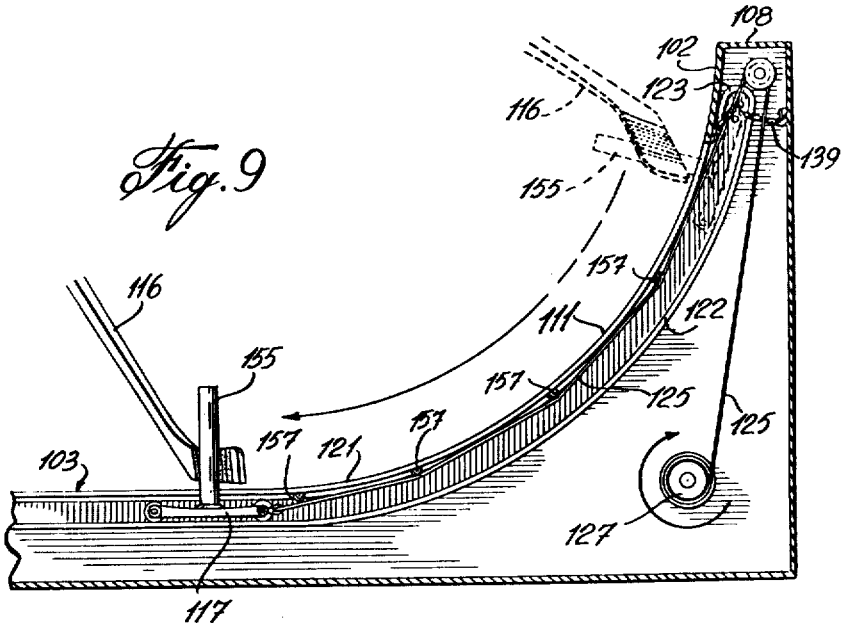
FIG. 9 is longitudinal cross-sectional view of a modification of the device.

The device can be modified to help a player develop the proper action and strength for a semi slap-shot. As shown in FIG. 9, a platform 103 is provided, similar to platform 3 except that the rear end 102 of the playing surface 111 curves upwardly toward a top end wall 108. The tracks 122 also curve upwardly at their rear end following the curve of playing surface 111. Slot 121 extends through most of the curved rear end 102. As before, a carriage 117 rides on tracks 122 and is biased toward the closed rear end 123 of tracks 122, via cord 125, by resilient means such as a spring-loaded spool 127. Cushioning means in the form of elastic bands 139 can be provided as before. A peg 155 is attached to carriage 117 and projects through slot 121. In use, the player stands on a stand as before positioned relative to platform 103. The hockey stick 116 is placed behind peg 155 with the peg at the top of the slot in a start position and the peg 155 is then propelled by the stick, the stick following surface in a downwardly curved path as is common in a proper slap shot. In this embodiment, the cord 125 is attached to the carriage in a position such that it follows a path offset laterally from slot 121 so that the cord emerges from the slot. The cord can be guided along a series of rollers 157 attached at spaced locations beneath surface 111.

I claim:

1. A hockey training device comprising:

an elongated platform having an elevated top practicing wall formed with a through slot extending longitudinally thereon over the major portion thereof;

a pair of guide members, each provided on one side of said slot, parallel to said slot and to said practicing wall and means mounting said guide members beneath said practicing wall;

a carriage mounted beneath said practicing wall and having freely spinning wheels laterally mounted thereon and riding on said guide members;

a vertical post projecting from said carriage through said slot and above said practicing wall;

a puck secured at the top of said post to be hit by a player whereby said puck and carriage may be displaced from one end of said slot to the other;

resilient return means including a spring loaded spool beneath said practicing wall behind said one end of said slot with respect to said other end and a cord fixed at one end to said carrier and wound on said spool at the other end when said carrier is at said one end of said slot, whereby when said puck is hit by a player, it is propelled with said carriage toward said other end of said slot until the momentum thereof is lost at which time the puck and carriage return to said one end under the action of said spring loaded spool.

2. A device as claimed in claim 1, wherein said platform is hollow and includes a bottom wall and means at said one end of said slot to cushion said carriage as it reaches said one end of said slot upon its return, said cushioning means being in the form of at least one elastic band secured at one end to and beneath said practicing wall and at the other end to said bottom wall.

3. A device as claimed in claim 1, including means for adjusting the resiliency of said spring-loaded spool so as to vary the force needed to propel the puck, said adjusting means including a handle positioned on said practicing wall for manual operation by a user.

4. A device as claimed in claim 1, wherein the end of said practicing wall away from said one end of said slot slopes convexly downward, said slot extending into said sloping end of said practicing wall whereby said puck and carriage follow said slope when propelled.

5. A device as claimed in claim 1, wherein the end of said practicing wall corresponding to said one end of said slot slopes concavely upwardly, said slot extending into said sloping end of said practicing wall whereby said puck and carriage follow said concave slope when said puck is hit, the hockey stick of a player also following the concave slope when propelling the puck and carriage.

6. A device as claimed in claim 1, including a stand for a player to stand on and means removably fixing said stand on either one of the two sides of said platform, said stand having a top resting surface higher than the top surface of said practicing wall by a distance such as to place a player in a position, relative to said practicing wall, as if a player were wearing skates.

* * * * *